US009044873B2

(12) United States Patent
Guglielmetti et al.

(10) Patent No.: US 9,044,873 B2
(45) Date of Patent: Jun. 2, 2015

(54) FLUID-JET SYSTEMS INCLUDING MULTIPLE INDEPENDENTLY-CONTROLLABLE BRIDGES AND FLUID-JET CUTTING HEADS, AND ASSOCIATED METHODS

(75) Inventors: Brian K. Guglielmetti, Bonney Lake, WA (US); Kevin A. Hay, Des Moines, WA (US)

(73) Assignee: OMAX Corporation, Kent, WA (US)

( * ) Notice: Subject to any disclaimer, the term of this patent is extended or adjusted under 35 U.S.C. 154(b) by 875 days.

(21) Appl. No.: 13/069,235

(22) Filed: Mar. 22, 2011

(65) Prior Publication Data

US 2011/0232442 A1 Sep. 29, 2011

Related U.S. Application Data

(60) Provisional application No. 61/316,341, filed on Mar. 22, 2010.

(51) Int. Cl.
*B24B 49/00* (2012.01)
*B26F 3/00* (2006.01)
*B26D 5/00* (2006.01)

(52) U.S. Cl.
CPC ..... *B26F 3/004* (2013.01); *B26D 5/005* (2013.01)

(58) Field of Classification Search
CPC ..... B26D 5/005; B26F 3/004
USPC ..... 451/5, 11, 36, 38, 75, 87
See application file for complete search history.

(56) References Cited

U.S. PATENT DOCUMENTS

| | | | | |
|---|---|---|---|---|
| 3,424,357 | A * | 1/1969 | Huffman et al. | 225/2 |
| 4,495,845 | A * | 1/1985 | Sherby | 83/886 |
| 4,920,495 | A | 4/1990 | Pilkington | |
| 5,806,390 | A | 9/1998 | Pomerleau et al. | |
| 6,430,787 | B1 | 8/2002 | Becan et al. | |
| 8,534,787 | B2 | 9/2013 | Yafe | |
| 2008/0110311 | A1 * | 5/2008 | Stangherlin | 83/177 |
| 2009/0064832 | A1 * | 3/2009 | Caretta et al. | 83/76.7 |
| 2009/0272409 | A1 * | 11/2009 | Petit | 134/32 |
| 2010/0066786 | A1 * | 3/2010 | Yafe | 347/40 |

OTHER PUBLICATIONS

Carinox S.A. Purchases Third Waterjet Cutting Machine from Flow International Corporation, Dec. 18, 2003, scanned into the PTO application.*

Non-Final Office Action for U.S. Appl. No. 12/083,133, filed May 20, 2008, mailed Jun. 20, 2012, 9 pages.

* cited by examiner

*Primary Examiner* — Maurina Rachuba
(74) *Attorney, Agent, or Firm* — Perkins Coie LLP

(57) ABSTRACT

Various embodiments of fluid-jet systems are described herein. In one embodiment, a fluid-jet system includes a table and two bridges that are each longitudinally movable along the table. Each bridge carries a fluid-jet cutting head latitudinally movable along the bridge. The fluid-jet system also includes a first controller operably coupled to the first bridge and the first fluid-jet cutting head. The first controller controls the first bridge and the first fluid-jet cutting head. The fluid-jet system also includes a second controller operably coupled to the second bridge and the second fluid-jet cutting head. The second controller controls the second bridge and the second fluid-jet cutting head independently of the control of the first bridge and the first fluid-jet cutting head by the first controller.

24 Claims, 3 Drawing Sheets

FLUID-JET SYSTEMS INCLUDING MULTIPLE INDEPENDENTLY-CONTROLLABLE BRIDGES AND FLUID-JET CUTTING HEADS, AND ASSOCIATED METHODS

CROSS-REFERENCE TO RELATED APPLICATIONS

This application claims the benefit of U.S. Provisional Patent Application No. 61/316,341, entitled "WATERJET SYSTEMS INCLUDING MULTIPLE INDEPENDENTLY-CONTROLLABLE BRIDGES AND WATERJET CUTTING HEADS, AND ASSOCIATED METHODS" filed Mar. 22, 2010, which is incorporated herein by reference in its entirety.

TECHNICAL FIELD

This application is directed to fluid cutting systems, such as waterjet cutting systems, and methods associated with such systems.

BACKGROUND

Waterjet systems produce high-velocity waterjets for accurately and precisely cutting various materials. Waterjet systems typically function by pressurizing water (or another suitable fluid) to a very high pressure (e.g., up to 90,000 pounds per square inch (psi) or more) by, for example, a high-pressure pump connected to an abrasive jet cutting head. The pressurized water is forced through an orifice at a very high speed (e.g., up to 2,500 feet per second or more). The orifice forms the waterjet. The orifice is typically a hard jewel (e.g., a synthetic sapphire, ruby, or diamond) held in an orifice mount. The resulting waterjet is discharged from the orifice at a velocity that approaches or exceeds the speed of sound. The liquid most frequently used to form the jet is water, and the high-velocity jet may be referred to as a "waterjet," or a "water jet."

Abrasives can be added to the waterjet to improve the cutting power of the waterjet. Adding abrasives to the waterjet produces an abrasive-laden waterjet referred to as an "abrasive waterjet" or an "abrasive jet." To produce an abrasive jet, the waterjet passes through a mixing region in a nozzle. The abrasive, which is under atmospheric (ambient) pressure in an external hopper, is conveyed through a meeting orifice via a gravity feed from the hopper through an attached abrasive supply conduit to the nozzle. A quantity of abrasive regulated by the meeting orifice is entrained into the waterjet in the mixing region by the low-pressure region that surrounds the flowing liquid in accordance with the Venturi effect. Typical abrasives include garnet and aluminum oxide. The abrasives can have grit mesh sizes ranging between approximately #36 and approximately #320, as well as other smaller and larger sizes.

The resulting abrasive-laden waterjet is then discharged against a workpiece through a nozzle tip that is adjacent to the workpiece. The abrasive jet can be used to cut a wide variety of materials. For example, the abrasive jet can be used to cut hard materials (such as tool steel, aluminum, cast-iron armor plate, certain ceramics and bullet-proof glass) as well as soft materials (such as lead). A typical technique for cutting by an abrasive jet is to mount a workpiece to be cut in a suitable jig, or other means for securing the workpiece into position. The abrasive jet can be directed onto the workpiece to accomplish the desired cutting, generally under computer or robotic control. It is generally not necessary to keep the workpiece stationary and to manipulate the abrasive jet cutting tool. The workpiece can be manipulated under a stationary cutting jet, or both the abrasive jet and the workpiece can be manipulated to facilitate cutting.

DETAILED DESCRIPTION

Figure 1:
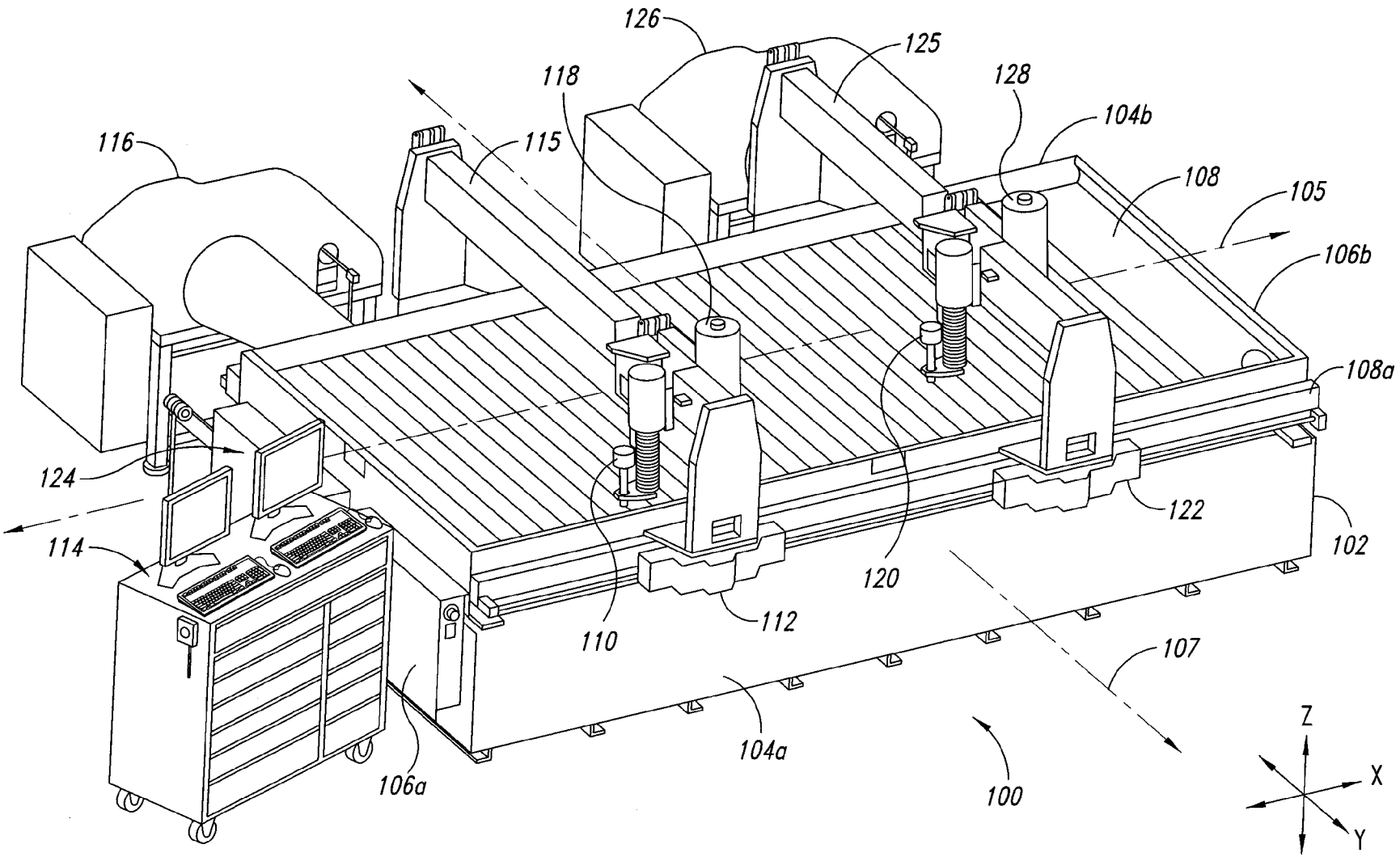
FIG. 1 is an isometric view of a fluid-jet system configured in accordance with an embodiment of the disclosure.

This application describes various embodiments of fluid-jet or waterjet systems for cutting materials, including waterjet systems having multiple independently-controllable combinations of a bridge and one or more waterjet cutting heads. For example, fluid-jet systems as disclosed herein can be used with a variety of suitable working fluids or liquids to form the fluid jet. More specifically, jet systems configured in accordance with embodiments of the present disclosure can utilize working fluids such as water, aqueous solutions, paraffins, oils (e.g., mineral oils, vegetable oil, palm oil, etc.), glycol, liquid nitrogen, and other suitable jet cutting fluids. As such, the term "water jet" or "waterjet" as used herein may refer to a cutting jet formed by any working fluid associated with the corresponding abrasive jet system, and is not limited exclusively to water or aqueous solutions. In addition, although several embodiments of the present disclosure are described below with reference to water, other suitable working fluids can be used with any of the embodiments described herein. Moreover, as described in detail below, abrasives can be added to waterjet cutting systems configured in accordance with embodiments of the disclosure. Certain details are set forth in the following description and in FIGS. 1-3 to provide a thorough understanding of various embodiments of the technology. Other details describing well-known aspects of waterjet systems, however, are not set forth in the following disclosure so as to avoid unnecessarily obscuring the description of the various embodiments.

Many of the details, dimensions, angles and other features shown in the Figures are merely illustrative of particular embodiments. Accordingly, other embodiments can have other details, dimensions, angles and features. In addition, further embodiments can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1.

In one embodiment, a waterjet system includes a table having two opposing sides and a fluid or water tank therebetween. The table has longitudinal guides (e.g., rails) positioned on the each side. The waterjet system also includes a first bridge movable along the longitudinal guides. The first bridge includes a first latitudinal guide (e.g., a rail) and carries a first waterjet cutting head movable along the first latitudinal guide. The waterjet system also includes a second bridge movable along the longitudinal guides. The second bridge includes a second latitudinal guide (e.g., a rail) and carries a second waterjet cutting head movable along the second latitudinal guide.

The waterjet system also includes a first controller operably coupled to the first bridge and the first waterjet cutting head. The first controller controls the first bridge and the first waterjet cutting head. The waterjet system also includes a second controller operably coupled to the second bridge and the second waterjet cutting head. The second controller controls the second bridge and the second waterjet cutting head independently of the control of the first bridge and the first waterjet cutting head by the first controller.

In another embodiment, a method of operating a waterjet system includes controlling a first bridge longitudinally movable along a waterjet cutting table and a first waterjet cutting head latitudinally movable along the first bridge. The method further includes controlling a second bridge longitudinally movable along the waterjet cutting table and a second waterjet cutting head latitudinally movable along the second bridge. The control of the first bridge and the first waterjet cutting head is independent of the control of the second bridge and the second waterjet cutting head.

In a further embodiment, a method for modifying a waterjet system includes operably coupling a second bridge and a second waterjet cutting head to a waterjet system that already has a first bridge and a first waterjet cutting head that are controlled by a first controller. The method further includes operably coupling the second bridge and the second waterjet cutting head to a second controller. The second controller is configured to control the second bridge and the second waterjet cutting head independently of the control of the first bridge and the first waterjet cutting head by the first controller.

Waterjet Systems and Associated Methods

FIG. 1 is an isometric view of a waterjet system 100 configured in accordance with an embodiment of the disclosure. The waterjet system 100 includes a generally rectangular table 102. The table 102 has two generally parallel opposing first sides 104 (shown individually as sides 104*a* and 104*b*) that are generally parallel to a longitudinal axis 105 of the table 102. The table 102 also has two generally parallel opposing second sides 106 (shown individually as sides 106*a* and 106*b*) that are generally parallel to a latitudinal axis 107 that is generally perpendicular to the longitudinal axis 105. The longitudinal axis 105 may be referred to as the X-axis 105 and the latitudinal axis 107 may be referred to as the Y-axis. The table 102 supports a water tank 108 configured to hold water or other suitable working fluids.

The waterjet system 100 has two longitudinal guides 108 (e.g., rails) positioned on the first sides 104 (only a first longitudinal guide 108*a* is illustrated in FIG. 1) that are generally parallel to the longitudinal axis 105. The waterjet system 100 also includes a first bridge 112 (alternatively referred to as a first Y-bridge 112) that is longitudinally movable (e.g., by a traction drive system) along the two longitudinal guides 108 parallel to the X-axis 105. The first bridge 112 has a first latitudinal guide 115 (e.g., a rail) that is generally parallel to the latitudinal axis 107. The first bridge 112 carries a first waterjet cutting head 110 that is latitudinally movable (e.g., by a traction drive system) along the first latitudinal guide 115 parallel to the Y-axis 107. The first waterjet cutting head 110 is also movable in a vertical dimension (which may be referred to as the Z-axis relative to the X-axis 105 and the Y-axis 107). The first bridge 112 also carries a first abrasive container 118 that can contain abrasives.

The waterjet system 100 also includes a first high-pressure fluid or water source 116 (e.g., a pump) operably coupled to the first waterjet cutting head 110. The first high-pressure water source 116 provides high-pressure water (or other suitable fluid) to the first waterjet cutting head 110. The first waterjet cutting head 110 receives the high-pressure water and forms a first waterjet for use in cutting operations. The first waterjet cutting head 110 can mix abrasives from the first abrasive container 118 to form a first abrasive jet for use in cutting operations. The waterjet system 100 can also include high-pressure pump components (e.g., tubing, lines, etc., not shown in FIG. 1).

The waterjet system 100 also includes a first controller 114 operably coupled (e.g., wirelessly or by wiring) to the first bridge 112 and the first waterjet cutting head 110. The first controller 114 can be a computer having a processor, memory (e.g., ROM, RAM) storage media (e.g., hard drive, flash drive, etc.) user input devices (e.g., keyboard, mouse, touchscreen, etc.), output devices (e.g., displays), input/output devices (e.g., network card, serial bus, etc.), an operating system (e.g., a Microsoft Windows operating system), and application programs and data. The first controller 114 can include layout software for generating and/or importing Computer-Aided Design (CAD) drawings or other suitable drawings or information from which cutting operations can be derived. The first controller 114 also includes control software for controlling the first bridge 112 and the first waterjet cutting head 110.

The control software can generate first control instructions for controlling the first bridge 112 and the first waterjet cutting head 110 based on CAD drawings. The first controller 114 controls movement of the first bridge 112 in the longitudinal direction, movement of the first waterjet cutting head 110 in the latitudinal direction, as well as other aspects of the first waterjet cutting head 110 (e.g., Z-axis movement, turning the waterjet/abrasive jet on and off, water pressure, etc.).

The waterjet system 100 also includes a second bridge 122 (alternatively referred to as a second Y-bridge 122). The second bridge 122 is also longitudinally movable (e.g., by a traction drive system) along the two longitudinal guides 108. The second bridge 122 has a second latitudinal guide 125 (e.g., a rail) that is generally parallel to the latitudinal axis 107. The second bridge 122 carries a second waterjet cutting head 120 that is latitudinally movable (e.g., by a traction drive system) along the second latitudinal guide 125. The second waterjet cutting head 120 is also movable in the vertical dimension. The second bridge 122 also carries a second abrasive container 128 that can contain abrasives. The second waterjet cutting head 120 receives high-pressure water from a second high-pressure fluid or water source 126 (e.g., a second pump) to which the second waterjet cutting head 120 is operably coupled and forms a second waterjet for use in cutting operations. The second waterjet cutting head 120 can mix abrasives from the second abrasive container 128 to form a second abrasive jet for use in cutting operations.

The waterjet system 100 also includes a second controller 124 operably coupled (by, e.g., wiring, not shown in FIG. 1) to the second bridge 122 and the second waterjet cutting head 120. The second controller 124 can be configured generally similar to the first controller 114. In some embodiments, the first 114 and second 124 controllers share the same user input devices and user output devices, and an operator can switch between the first controller 114 and the second controller 124 (by, e.g., using a keyboard-video-mouse switch box). The second controller 124 controls the movement of the second bridge 122 in the longitudinal direction, movement of the second waterjet cutting head 120 in the latitudinal direction, and other aspects of the second waterjet cutting head 120 (e.g., Z-axis movement, turning the waterjet/abrasive jet on and off, water pressure, etc.).

The second controller 124 controls the second bridge 122 and the second waterjet cutting head 120 independently of the first controller 114. The control of the second bridge 122 and the second waterjet cutting head 120 by the second controller is independent of control of the first bridge 112 and the first waterjet cutting head 110 by the first controller 114. For example, the first controller 114 can be programmed using a first instruction set to control the first bridge 112 and the first waterjet cutting head 110 and the second controller 124 can be programmed using a second instruction set, distinct from the first instruction set, to control the second bridge 122 and the second waterjet cutting head 120. The second instruction set can be identical to or different from the first instruction set.

Examples of how the first bridge 112 and the first waterjet cutting head 110 can operate independently of the second bridge 122 and the second waterjet cutting head 120 include at least the following. The first bridge 112 can move along the longitudinal guides 108 in a first longitudinal direction and the second bridge 122 can simultaneously move along the longitudinal guides 108 in the opposite second longitudinal direction. The first bridge 112 and the second bridge 122 can simultaneously move in the same longitudinal direction, but the first waterjet cutting head 110 can move along the first latitudinal guide 115 in a first latitudinal direction and the second waterjet cutting head 120 can simultaneously move along the second latitudinal guide 125 in the opposing second latitudinal direction. The first bridge 112 and first waterjet cutting head 110 can remain stationary while either or both of the second bridge 122 and the second waterjet cutting head 120 moves. The first waterjet cutting head 110 can be configured to reduce taper and the second waterjet cutting head 120 can be configured to cut large angles from vertical (e.g., up to 60 degrees). The first waterjet cutting head 110 can cut a first workpiece according to a first instruction set from the first controller 114 and the second waterjet cutting head 120 can cut a second workpiece, different from the first workpiece, according to a second instruction set from the second controller 124. These examples are illustrative and not limiting. Those of skill in the art will understand various ways by which the first bridge 112 and the first waterjet cutting head 110 exhibit independence from the second bridge 122 and the second waterjet cutting head 120.

Boundaries can be defined (by, e.g., an operator) for one or both of the first 112 and second 122 bridges such that the two bridges do not collide during operation. In some embodiments, the first 112 and second 122 bridges include sensors that detect imminent or occurring collisions (e.g., collisions such as the two bridges colliding with each other, or either bridge colliding with an end of the table 102) and send signals to the first controller 114 and the second controller 124 that cause either or both of the first bridge 112 and the second bridge 122 to stop, thereby averting a collision or attempting to avert a collision.

Figure 2:
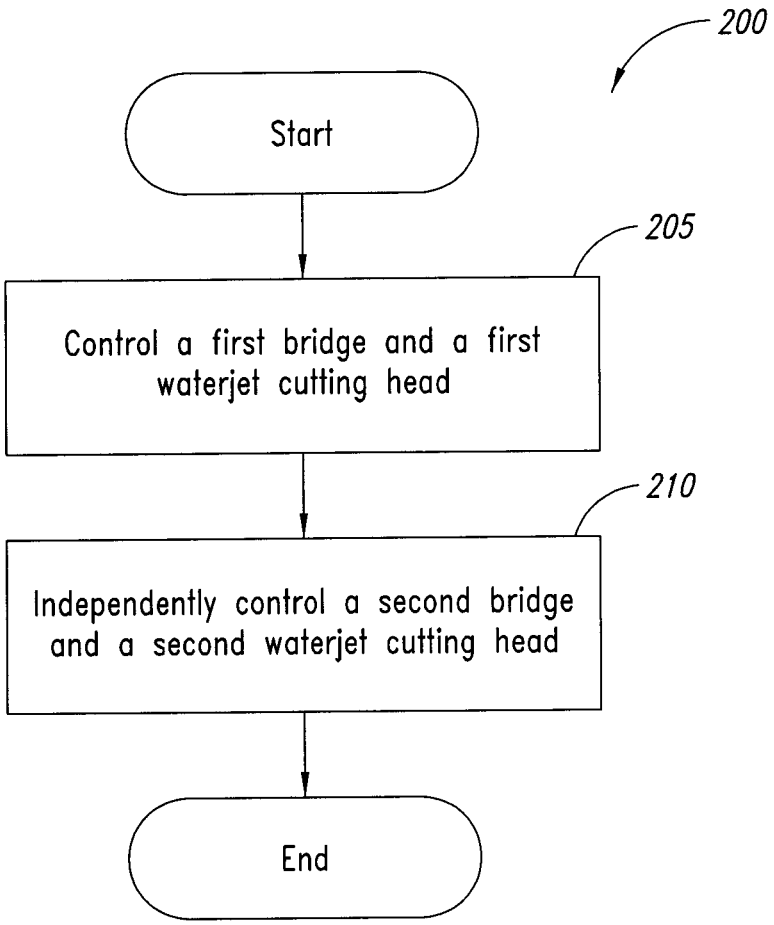
FIG. 2 is a flow diagram of a process for operating a fluid-jet system in accordance with an embodiment of the disclosure.

FIG. 2 is a flow diagram of a process 200 for operating a waterjet system, such as the waterjet system 100 described above with reference to FIG. 1, in accordance with an embodiment of the disclosure. The waterjet system has a table, first and second bridges longitudinally movable along the table, and first and second waterjet cutting heads latitudinally movable along the first and second bridges, respectively. The process 200 begins at step 205, where a first controller of the waterjet system controls the first bridge and the first waterjet cutting head. At step 210, a second controller of the waterjet system independently controls the second bridge and the second waterjet cutting head. The process 200 then concludes.

The waterjet system can utilize the process 200 to cut multiple parts simultaneously. For example, the waterjet system can cut the multiple parts identically or in different fashions (e.g., the first and second waterjet cutting heads can produce different parts). As another example, the waterjet system could control the first bridge and the first waterjet cutting head to cut a first portion of a workpiece and also independently control the second bridge and the second waterjet cutting head to cut a second portion of the workpiece (which may or may not overlap with the first portion). As another example, the waterjet system could control both bridges and both waterjet cutting heads to cut the same workpiece, and then idle the first bridge and first waterjet cutting head in favor of the second bridge and second waterjet cutting head (e.g., the second waterjet cutting head can make a final cut or otherwise finalize processing the workpiece).

Figure 3:
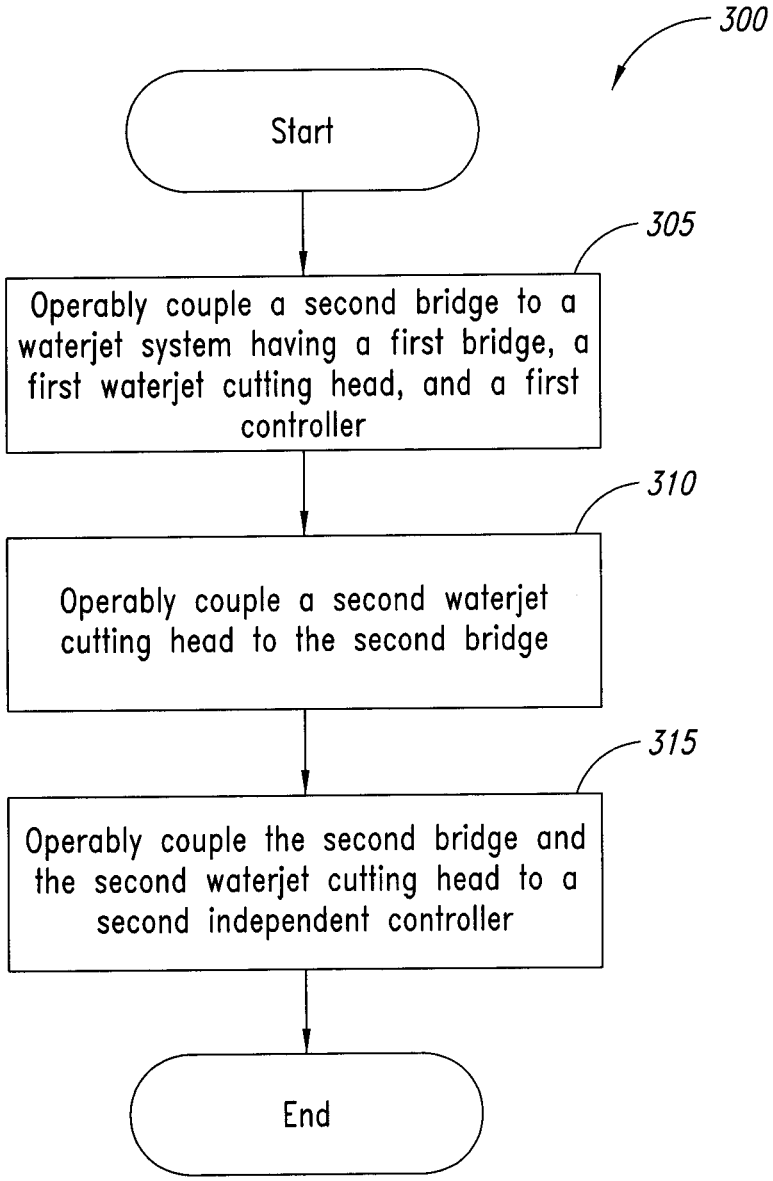
FIG. 3 is a flow diagram of a process for modifying a fluid-jet system in accordance with an embodiment of the disclosure.

FIG. 3 is a flow diagram of a process 300 for modifying a waterjet system, such as the waterjet system 100 as described above with reference to FIG. 1, in accordance with an embodiment of the disclosure. The waterjet system has a table with an X-axis and a perpendicular Y-axis. The waterjet system also has a first bridge movable parallel to the X-axis along the table and a first waterjet cutting head movable parallel to the Y-axis along the first bridge. The waterjet system also has a first controller configured to control the first bridge and the first waterjet cutting head. The process 300 begins at step 305, where a second bridge is operably coupled to the waterjet system for movement of the second bridge along the table parallel to the X-axis. At step 310, a second waterjet cutting head is operably coupled to the second bridge for movement of the second waterjet cutting head along the second bridge parallel to the Y-axis. At step 315, the second bridge and the second waterjet cutting head are operably coupled to a second controller. The second controller is configured to control the second bridge and the second waterjet cutting head independently of the control of the first bridge and the first waterjet cutting head by the first controller. The process 300 then concludes.

Those skilled in the art will appreciate that the steps shown in any of FIGS. 2 and 3 may be altered in a variety of ways without departing from the spirit or scope of the present disclosure. For example, the order of the steps may be rearranged; substeps may be performed in parallel; shown steps may be omitted, or other steps may be included; etc.

Waterjet systems having multiple independently-controllable bridges, each carrying one or more independently-controllable waterjet cutting heads, and methods associated with such waterjet systems can provide certain advantages over conventional waterjet systems, such as those using ball screw drive systems. For example, a waterjet system having a single existing bridge and a single existing waterjet cutting head can be modified to include an additional bridge and an additional waterjet cutting head that can be controlled independently of the existing bridge and existing waterjet cutting head. Such a modified waterjet system can undertake two independent cutting operations, which can increase productivity without necessitating the purchase of an additional waterjet system.

Other advantages can also be provided by such waterjet systems and associated methods. For example, adding a second bridge adds the performance of a second waterjet system with minimal floor space impact, which can be advantageous in space-limited environments. As another example, each bridge and waterjet cutting head combination can be controlled by a separate instance of the same control software, thereby obviating the need for an operator to learn a different control system.

As another example, such waterjet systems can reduce production down times or setup times, as an operator may not need to stop all cutting to load or unload material. With multiple bridges and waterjet cutting heads, one bridge and waterjet cutting head can be idled (not forming a waterjet/abrasive jet) while the other(s) remain operation, thereby allowing an operator to load or unload material in the vicinity of the idled bridge and waterjet cutting head. As another example, if one bridge and waterjet cutting head combination is down or requires maintenance, the other bridge and waterjet cutting head combination can still be used. Accordingly, multiple independently-controllable waterjet cutting heads provide a desired redundancy.

Moreover, parts for the existing bridge and waterjet cutting head combination (e.g., consumable parts such as seals, valves, abrasive-jet nozzles, mixing tubes, orifices, high-pressure hose or high-pressure pump components) can be used with the second bridge and waterjet cutting head combination. As another example, a first waterjet cutting head can cut a workpiece (e.g., soft materials such as rubber) with a water-only jet stream and a second waterjet cutting head can cut (e.g., simultaneously) another workpiece (e.g., harder or thicker materials such as steel) with an abrasive jet stream.

The techniques described herein can be used in other beam cutting technologies, such as laser and plasma for example. More specifically, a laser cutting system can have a table with longitudinal guides along which multiple bridges are longitudinally movable. Each bridge can have a latitudinal guide and carry a laser cutting head that is latitudinally movable along the bridge. Each bridge and associated laser cutting head can be controlled independently of each other bridge and associated laser cutting head. As another example, a plasma cutting system can have a table with longitudinal guides along which multiple bridges are longitudinally movable. Each bridge can have a latitudinal guide and carry a plasma cutting head that is latitudinally movable along the bridge. Each bridge and associated plasma cutting head can be controlled independently of each other bridge and associated plasma cutting head. Those of skill in the art will understand from this disclosure that the disclosed techniques are applicable to other beam cutting technologies.

From the foregoing, it will be appreciated that specific embodiments have been described herein for purposes of illustration, but that various modifications may be made without deviating from the spirit and scope. Those skilled in the art will recognize that numerous liquids other than water can be used, and the recitation of a jet as including water should not necessarily be interpreted as a limitation. For example, fluids other than water can also be employed to cut materials that cannot be in contact with water. A customary term for the process of cutting with a fluid is "waterjet cutting" and the like, but the term "waterjet cutting" is not intended to exclude cutting by jets of fluid other than water or cutting by jets of fluid mixed with abrasives. As an example of another modification, although two independently controllable waterjet cutting heads have been described, more than two (e.g., three, four, or more) independently controllable waterjet cutting heads may be used. As another example, each bridge may carry multiple cutting waterjet cutting heads. As another example, multiple pumps may be used for each waterjet cutting head. As another example, the bridges are described as longitudinally movable along the table, but a waterjet system may be configured such that the bridges are latitudinally movable along the waterjet system table (with each waterjet cutting head longitudinally movable along the respective bridge).

As another example, although the first 114 and second 124 controllers are described as each being a separate computer with reference to FIG. 1, the first 114 and second controllers 124 may be both comprised in a single computer (e.g., a single computer running two separate instances of layout software and control software). Moreover, the term computer is intended to include any device or apparatus suitable for controlling the waterjet system. As another example, while instructions for controlling the bridges and the waterjet cutting heads have been described as being implemented in software, such instructions can be implemented in software, hardware, firmware, or any combination thereof. Further, while advantages associated with certain embodiments have been described in the context of those embodiments, other embodiments may also exhibit such advantages, and not all embodiments need necessarily exhibit such advantages to fall within the scope of the present disclosure. Moreover, the embodiments described may exhibit advantages other than those described herein.

We claim:

1. A method of operating a fluid-jet system, the method comprising:

controlling a first bridge longitudinally movable along a fluid-jet cutting table and a first fluid-jet cutting head latitudinally movable along the first bridge;

controlling a second bridge longitudinally movable along the fluid-jet cutting table and a second fluid-jet cutting head latitudinally movable along the second bridge;

defining a boundary between the first bridge and the second bridge;

detecting a breach of the boundary; and controlling movement of the first bridge in response to the detected breach, wherein controlling the first bridge comprises controlling the first bridge with a first controller, controlling the second bridge comprises controlling the second bridge with a second controller separate from the first controller, and control of the first bridge and the first fluid-jet cutting head is independent of control of the second bridge and the second fluid-jet cutting head.

2. The method of claim 1, further comprising:

generating first control instructions for controlling the first bridge and the first fluid-jet cutting head; and generating second control instructions, distinct from the first control instructions, for controlling the second bridge and the second fluid-jet cutting head, wherein controlling the first bridge and the first fluid-jet cutting head includes controlling the first bridge and the first fluid-jet cutting head according to the first control instructions, and wherein controlling the second bridge and the second fluid-jet cutting head includes controlling the second bridge and the second fluid-jet cutting head according to the second control instructions.

3. The method of claim 1, further comprising:

controlling the first fluid-jet cutting head to not form a fluid-jet; and while the first fluid-jet cutting head is not forming a fluid-jet, controlling the second fluid-jet cutting head to form a fluid-jet.

4. The method of claim 1 wherein detecting the breach of the boundary includes detecting an imminent collision between the first bridge and the second bridge.

5. The method of claim 1 wherein detecting the breach of the boundary includes detecting an imminent collision between the fluid-jet cutting table and the first bridge.

6. The method of claim 1 wherein detecting the breach of the boundary includes detecting an occuring collision between the first bridge and the second bridge.

7. The method of claim 1 wherein detecting the breach of the boundary includes detecting an occuring collision between the fluid-jet cutting table and the first bridge.

8. The method of claim 1 wherein the first bridge includes a sensor, and wherein detecting the breach of the boundary includes detecting a collision with the first bridge based on signals received from the sensor.

9. The method of claim 1 wherein the first bridge includes a sensor, and wherein detecting the breach of the boundary includes detecting an imminent collision with the first bridge based on signals received from the sensor.

10. The method of claim 1 wherein the second bridge includes a sensor, and wherein detecting the breach of the boundary includes detecting a collision with the first bridge based on signals received from the sensor.

11. The method of claim 1 wherein the second bridge includes a sensor, and wherein detecting the breach of the boundary includes detecting an imminent collision with the first bridge based on signals received from the sensor.

12. The method of claim 1 wherein controlling movement of the first bridge in response to the detected breach includes stopping movement of the first bridge.

13. A method of modifying a fluid-jet system, wherein the fluid-jet system includes a table having an X-axis generally perpendicular to a Y-axis, a first bridge movable along the table parallel to the X-axis, and a first fluid-jet cutting head movable along the first bridge parallel to the Y-axis, and wherein the first bridge and the first fluid jet cutting head are operably coupled to a first controller configured to control the first bridge and the first fluid-jet cutting head, the method comprising:

operably coupling a second bridge to the table of the fluid-jet system for movement of the second bridge along the table parallel to the X-axis;

operably coupling a second fluid-jet cutting head to the second bridge for movement of the second fluid-jet cutting head along the second bridge parallel to the Y-axis;

operably coupling the second bridge and the second fluid-jet cutting head to a second controller, wherein the second controller is configured to control the second bridge and the second fluid-jet cutting head independently of the control of the first bridge and the first fluid-jet cutting head by the first controller;

installing one or more sensors on at least one of the first bridge and the second bridge; and operably coupling the one or more sensors to at least one of the first controller and the second controller, the at least one of the first controller and the second controller including control software for maintaining a boundary between the first bridge and the second bridge and thereby preventing a collision between the first bridge and the second bridge of the fluid-jet system during operation based on signals received from the one or more sensors.

14. The method of claim 13, further comprising:

generating first control instructions;

generating second control instructions distinct from the first control instructions;

controlling, by the first controller, the first bridge and the first fluid-jet cutting head according to the first control instructions; and controlling, by the second controller, the second bridge and the second fluid-jet cutting head according to the second control instructions.

15. The method of claim 13, further comprising generating control instructions that detect a breach of the boundary based on the signals received from the one or more sensors.

16. The method of claim 15, further comprising generating control instructions that control movement of the first bridge in response to the breach of the boundary being detected.

17. The method of claim 15, further comprising generating control instructions that stop movement of the first bridge in response to the breach of the boundary being detected.

18. The method of claim 15, further comprising generating control instructions that stop movement of both the first bridge and the second bridge in response to the breach of the boundary being detected.

19. A fluid-jet cutting system comprising:

a fluid-jet cutting table;

a first bridge movable along the fluid-jet cutting table;

a first fluid-jet cutting head movable along the first bridge;

a first controller configured to— control longitudinal movement of the first bridge along the fluid-jet cutting table, and control latitudinal movement of the first fluid-jet cutting head along the first bridge;

a second bridge movable along the fluid-jet cutting table;

a second fluid-jet cutting head movable along the second bridge; and a second controller separate from the first controller, the second controller configured to— control longitudinal movement of the second bridge along the fluid-jet cutting table, control latitudinal movement of the second fluid-jet cutting head along the second bridge, define a boundary between the first bridge and the second bridge, detect a breach of the boundary, and control movement of the second bridge in response to detecting the breach of the boundary, wherein control of the second bridge and the second fluid-jet cutting head is independent of control of the first bridge and the first fluid-jet cutting head.

20. The system of claim 19 wherein detecting the breach of the boundary includes detecting an imminent collision between the second bridge and the first bridge.

21. The system of claim 19 wherein detecting the breach of the boundary includes detecting an imminent collision between between the fluid-jet cutting table and the second bridge.

22. The system of claim 19 wherein detecting the breach of the boundary includes detecting an occuring collision between the second bridge and the first bridge.

23. The system of claim 19 wherein detecting the breach of the boundary includes detecting an occuring collision between the fluid-jet cutting table and the second bridge.

24. The method of claim 19 wherein the second bridge includes a sensor, and wherein detecting the breach of the boundary includes detecting a collision with the second bridge based on signals received from the sensor.

* * * * *